United States Patent [19]

Sturgis

[11] 4,024,783

[45] May 24, 1977

[54] POWER SAW APPARATUS AND MITER ATTACHMENT THEREFOR

[76] Inventor: Clifford M. Sturgis, 1213 Westmoreland, Colorado Springs, Colo. 80907

[22] Filed: Jan. 14, 1976

[21] Appl. No.: 649,095

[52] U.S. Cl. ..... 83/468; 83/471.3; 83/485; 83/581

[51] Int. Cl.[2] ..... B27B 27/06

[58] Field of Search ..... 83/471.3, 471.2, 485, 83/581, 468, 467; 269/315–319

[56] References Cited

UNITED STATES PATENTS

| | | | |
|---|---|---|---|
| 131,949 | 10/1872 | Green | 83/471.2 |
| 179,944 | 7/1876 | Nichols | 83/471.2 X |
| 194,237 | 8/1877 | Green | 83/471.2 |
| 275,666 | 4/1883 | Johnston | 83/581 X |
| 2,595,322 | 5/1952 | Avery | 83/471.3 X |
| 2,680,458 | 6/1954 | Grammer | 83/581 X |
| 3,352,334 | 11/1967 | Hunn | 83/471.3 X |
| 3,392,761 | 7/1968 | Klein | 83/467 X |
| 3,830,127 | 8/1974 | James et al. | 83/581 X |
| 3,901,498 | 8/1975 | Novak | 83/471.3 X |
| 3,945,281 | 3/1976 | Kreitz | 83/471.3 X |

*Primary Examiner*—Frank T. Yost
*Attorney, Agent, or Firm*—Fishburn, Gold & Litman

[57] ABSTRACT

A power saw apparatus or attachment therefor for cutting work pieces at any selected angle includes a power driven saw mounted on a support structure and movable along a cutting path relative to a top member or a table top portion to cut work pieces positioned in engagement with one or both of first and second fence members with each having one end thereof pivotally mounted on the top member and positioned on respective opposite sides of the cutting path. The first and second angular scales to indicate desired cutting angle through the respective work piece engaged therewith. First and second first retaining devices are mounted on the top member and connected to the first and second fence member for respectively holding same in a selected position.

8 Claims, 6 Drawing Figures

Fig. 3.
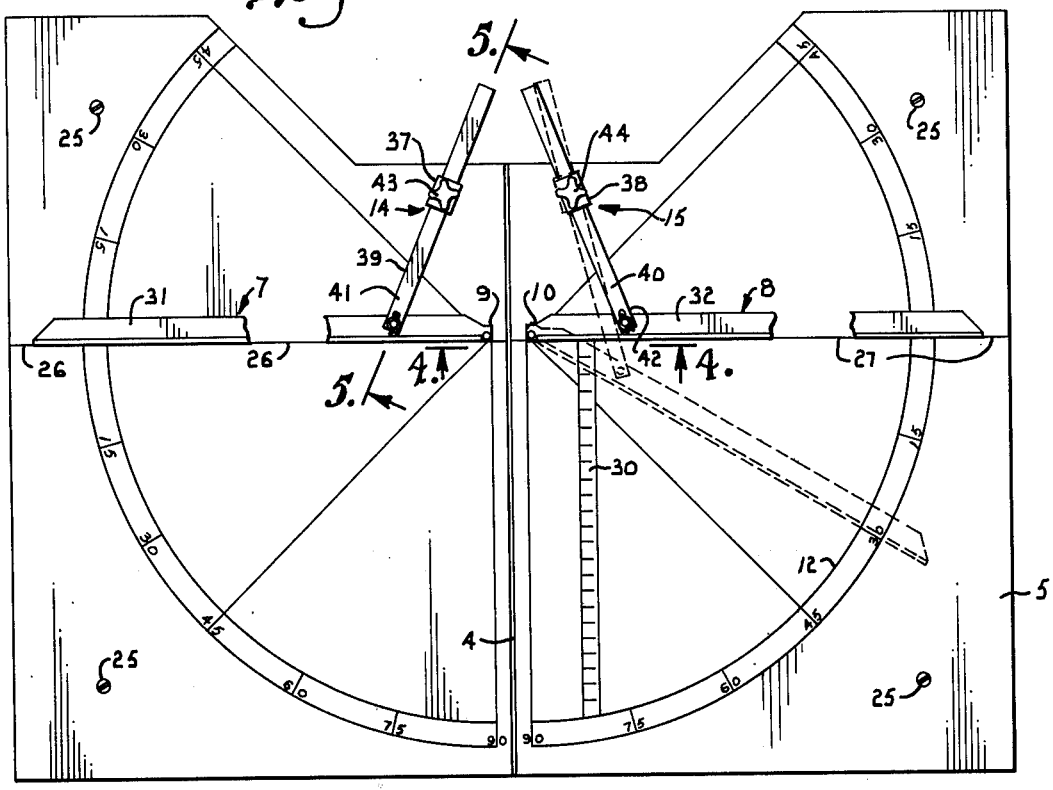
Fig. 4.
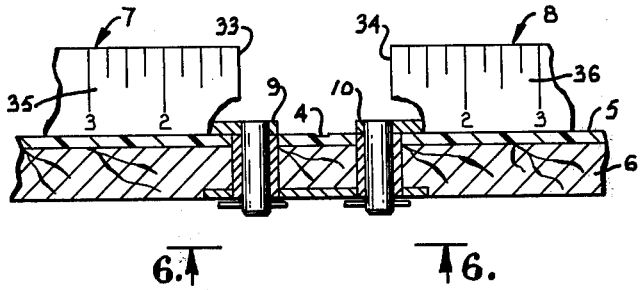
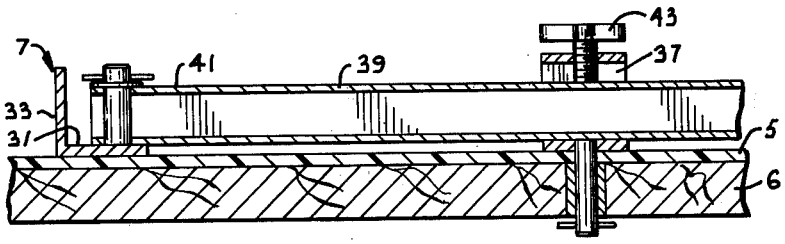
Fig. 5.
Fig. 6.
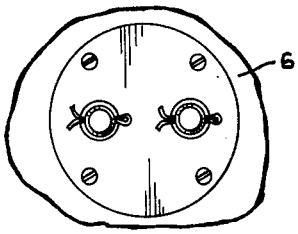

POWER SAW APPARATUS AND MITER ATTACHMENT THEREFOR

The present invention relates to power saw apparatus and more particularly to a power saw apparatus or attachment therefor having first and second fence members each movable relative to respective first and second angular scales to indicate a desired cutting angle through a respective work piece and having retaining devices for holding first and second fence members in respective selected positions.

The principal objects of the present invention are: to provide a power saw apparatus or attachment therefor having first and second fence members each adapted to be positioned at any selected angle for accurate cutting of respective work pieces; to provide such a power saw apparatus adapted to set or position first and second fence members to cut two work pieces at the same time without disturbing each other; to provide such a power saw apparatus having a saw blade movable along a cutting path with first and second fence members each having one end thereof pivotally mounted adjacent and on respective opposite sides of the cutting path and being movable relative to the cutting path for determining the angle of the cut whereby the saw blade always clears the fence members; to provide such a power saw apparatus having first and second fence retaining devices for respectively retaining the fence members in any selected position; to provide such a power saw apparatus having first and second base lines and first and second angle scales on a top member with the first and second fence members being movable relative to the respective scales to indicate respective angular spacing between the respective base line and the fence member; to provide such a power saw apparatus wherein the fence members each have linear indicia means thereon with zero at the cutting path and increasing along the respective fence member; and to provide such a power saw apparatus which is economical to manufacture, durable in construction, positive in operation, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include an exemplary embodiment of the present invention and illustrate various objects and features of the power saw apparatus.

FIG. 3 is an enlarged top plan view of the power saw apparatus taken on line 3—3 of FIG. 1 and shown with a power saw and saw mounting structure removed to better illustrate the top member and components thereon.

FIG. 4 is a further enlarged fragmentary transverse sectional view taken on line 4—4 of FIG. 3 and showing mounting of the fence members on a top member of a table top portion.

FIG. 5 is a further enlarged fragmentary transverse sectional view taken on line 5—5 of FIG. 3 and showing a fence retaining device mounted on the top member.

FIG. 6 is a fragmentary bottom plan view of the table top portion at a scale between that of FIG. 3 and FIGS. 4 and 5 and showing mounting of the fence members.

Figure 2:
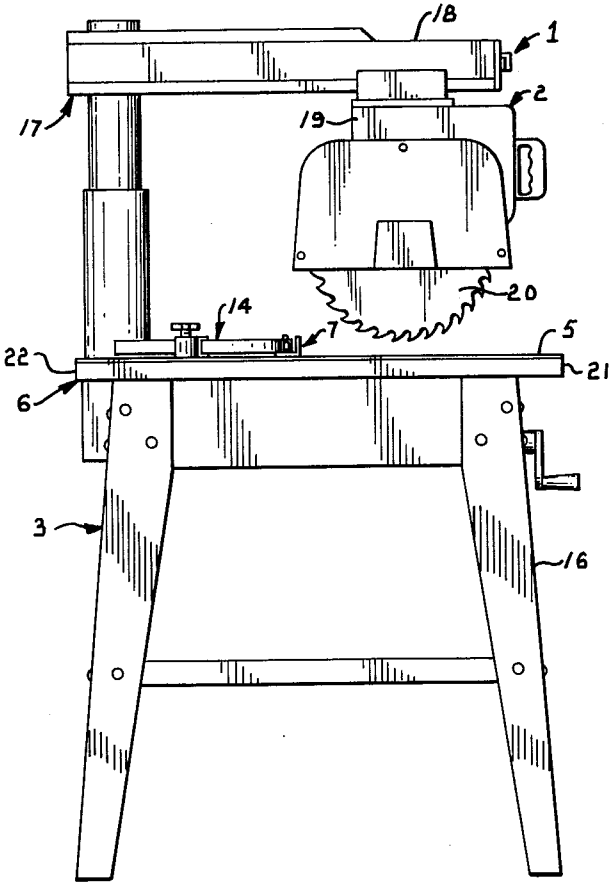
FIG. 2 is a side elevational view of the power saw apparatus.
Figure 1:
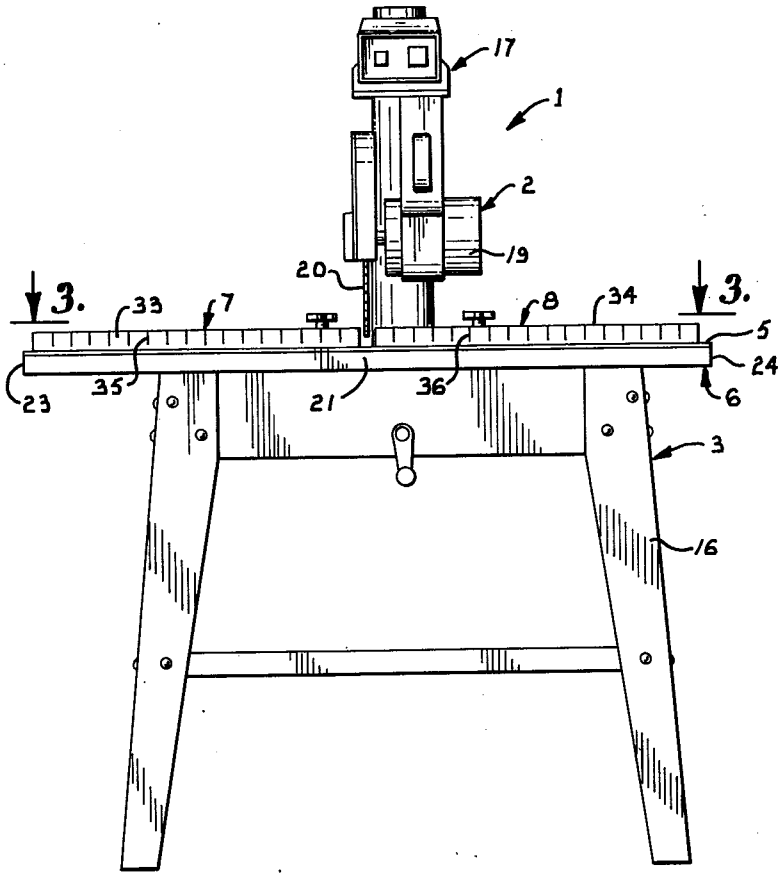
FIG. 1 is a front elevational view of a power saw apparatus embodying features of the present invention.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring more in detail to the drawings:

In the disclosed embodiment of the present invention, the reference numeral 1 designates generally a power saw apparatus adapted to cut work pieces at any selected angle. The power saw apparatus 1 includes a power driven saw 2 mounted on a support structure 3 and movable along a cutting path 4 in a top member 5 of a table top or desk portion 6 of the support structure 3 to cut work pieces positioned in engagement with one or both of first and second fence membes 7 and 8 which have a respective one end 9 and 10 thereof pivotally mounted on the top member 5 and positioned on respective opposite sides of the cutting path 4. The first and second fence members 7 and 8 are each selectively movable and have portions positioned relative to respective first and second angular scales 11 and 12 to indicate desired cutting angle through the respective work piece engaged therewith. First and second fence retaining devices 14 and 15 are mounted on the top member 5 and connected to the first and second fence members 7 and 8 for respectively holding same in a respective selected position.

The saw may be of conventional structure having a table to support work pieces and an arm thereover with a power saw movable in a fixed path defined by said arm. The support structure 3 may be any suitable structure adapted to support the power driven saw 2 and the operative components therefor and to support respective work pieces and work piece positioning components. In the illustrated embodiment, the support structure 3 includes a base portion 16 extending upwardly from a support surface, such as a floor, and having a table top portion 6 mounted thereon and positioned substantially horizontal.

A saw mounting structure 17 is mounted on the support structure 3 and positioned adjacent one side of the table top portion 6. The saw mounting structure 17 includes a housing or upright portion with a guide arm 18 extending therefrom and positioned above and substantially parallel with the cutting path 4 and parallel with the upper surface of the top member 5.

The power driven saw 2 is mounted on the saw mounting structure 17 and includes a suitable drive motor 19 on a carriage mounted on ways or guide portion of the guide arm 18 for movement longitudinally thereof. The drive motor 19 is operative to rotate a suitable saw blade 20 and movement of the carriage and drive motor 19 along the guide arm 18 moves the blade 20 along the cutting path 4.

The illustrated table top or deck portion 6 is planar and generally rectangular and has front and rear edges 21 and 22 and opposite end edges 23 and 24. The table top portion 6 has a suitable recess or cut-out portion in the rear edge 22 adapted to receive therein the saw mounting structure 17.

The top member 5 is also planar and has the same shape as the table top or deck portion 6 and has the cutting path 4 therein and extending between and substantially perpendicular or normal to the front and rear edges thereof. The top member 5 is preferably a removable member and is suitably secured in position by a plurality of spaced fastening devices, such as screws 25 having countersunk heads.

The top member 5 has first and second base lines 26 and 27 thereon and positioned substantially normal or perpendicular to and extending in respective opposite directions from the cutting path 5. The base lines 26 and 27 each indicate a position for the first and second fence members 7 and 8 respectively to effect a cut through a work piece at a zero degree angle or perpendicular to the longitudinal axis thereof. The top member 5 may have other guide lines thereon, such as 45 degree angle relative to the respective base lines 26 and 27, or at any other angular spacing desired.

The top member 5 has the first and second angular scales 11 and 12 thereon and positioned on respective opposite sides of the cutting path 4 and each within the length of the respective first and second fence members 7 and 8 to indicate the angular spacing between same and the first and second base lines 26 and 27 respectively. The illustrated first and second angular scales 11 and 12 are each portions of a circle and extend in opposite directions from the first and second base lines 26 and 27 respectively with zero at the respective base line and increasing in each direction therefrom.

The top member 5 also may have a linear scale or scales 30 spaced from and parallel with the cutting path 4 which would aid in indicating width or thickness of lumber or other work pieces being cut.

The top member 5 may be formed of any suitable material, however, it is preferable that the top member 5 be formed of plastic and have the base lines 26 an 27, angular scales 11 and 12, and the linear scale 30 formed therein so that the top member may be replaced in the event of damage and said scales will each have a longer useful life.

The first and second fence members 7 and 8 are positioned on respective opposite sides of the cutting path 4 in the top member 5 and have the one or first ends 9 and 10 thereof suitably pivotally mounted on the table and on respective opposite sides of the cutting path 4. The first and second fence members 7 and 8 are illustrated as angles having first legs 31 and 32 respectively thereof positioned horizontal or parallel with the top member 5 and second legs 33 and 34 extending upwardly or vertically from the horizontal first legs 31 and 32 respectively. The second legs 33 and 34 have planar faces which are adapted to be engaged by work pieces to position same. The second legs 33 and 34 have indicia means 35 and 36 respectively thereon and each indicia means is arranged to indicate the length of the work piece remaining after cutting thereof by the power saw blade 20.

The first and second fence retaining means 14 and 15 are mounted on the top member 5 and are respectively connected to the first and second fence members 7 and 8 for respectively retaining same in a selected position. In the illustrated structure, the first and second retaining means 14 and 15 include first and second guide members 37 and 38 each rotatably mounted on the top member 5 and positioned on respective opposite sides of the cutting path 4 and spaced therefrom. The guide members 37 and 38 are illustrated as sleeves or tubular members, for a purpose later described, with each having a shaft depending therefrom and mounted in a suitable bearing on the table top portion 6.

The first and second fence retaining means 14 and 15 include first and second elongated arms 39 and 49 which have one end 41 and 42 respectively thereof pivotally connected to the first and second fence members 7 and 8 respectively at a position spaced from the respective one end 9 and 10 thereof. The first and second arms 39 an 40 are illustrated as tubular bars or rods mounted in slidable engagement with the first and second guide members 37 and 38, as by being received within the tubular guide member.

The first and second fence retaining means 14 and 15 include first and second locking means 43 and 44 mounted on the first and second guide members 37 and 38 respectively and adapted to engage the first and second arms 39 and 40 and adapted to hold same against relative movement between the respective arm and guide member. The first and second locking means 43 and 44 are each illustrated as a knob or head portion mounted on one end of a threaded shaft extending through a threaded aperture in the respective guide members and selectively movable into engagement with the respective elongated arm.

In using a power saw apparatus constructed and assembled as illustrated and described, the locking means 43 and 44 are loosened and the fence members 7 and 8 are positioned at desired locations relative to the base lines 26 and 27 and relative to the angular scales 11 and 12 respectively. The locking means 43 and 44 are then tightened to retain the fence members 7 and 8 in the desired or selected location. The two fences may be adjusted to be in linear alignment so long pieces of material may engage both and be cut. One fence member may be positioned in a desired position and the other fence member may be positioned to clear the work when in engagement with the one fence member. The work pieces are positioned in engagement with the second or vertical legs 33 and 34 of the fence members 7 and 8 and adjusted linearly thereof to establish the desired length of the work piece remaining after cutting by the saw blade 20. The carriage and drive motor 19 is then moved along the guide arm 18 thereby the cutting blade 20 along the cutting path 4.

It is to be understood that while I have illustrated and described one form of my invention, it is not to be limited to the specific form or arrangement of parts herein described and shown.

What I claim and desire to secure by Letters Patent is:

1. A power saw apparatus comprising:

a. a support structure having a table top portion with front and rear edges and with a cutting path therein substantially normal to said front and rear edges;

b. a power saw having a cutting blade;

c. means mounted on said support structure and including an arm positioned above said table top portion and having said power saw movably supported thereon for guiding said power saw during movement thereof along said cutting path;

d. first and second fence members positioned on respective opposite sides of said cutting path and each having one end thereof pivotally mounted on said table top portion in spaced relation to the rear edge thereof and adjacent said cutting path for permitting movement to selected adjusted angular position relative to said cutting path; and e. first and second means mounted on said table top portion between said rear edge and respective fence members and connected respectively to said first and second fence members for respectively retaining same in a respective selected angular position.

2. A power saw apparatus comprising:

a. a support structure having a table top portion;

b. a top member mounted on said table top portion and having a cutting path therein and a base line extending normal to said cutting path;

c. a saw mounting structure mounted on said support structure and having a guide arm positioned above and substantially parallel with said cutting path in said top member;

d. a power saw mounted on said saw mounting structure and movable along said guide arm for moving a cutting blade thereof along said cutting path;

e. first and second fence members positioned on respective opposite sides of said cutting path and each having one end thereof pivotally mounted on said table top portion at said base line adjacent said cutting path in said top member for permitting movement of said fence members in either direction from said base line to selected angular positions relative to said cutting path; and f. first and second means mounted on said top member and connected respectively to said first and second fence members for respectively retaining same in a respective selected angular position.

3. A power saw apparatus as set forth in claim 2 wherein said first and second means for retaining said respective first and second fence member in a respective selected position includes:

a. first and second guide members each rotatably mounted on said top member and positioned on respective opposite sides of said cutting path in said top member and spaced therefrom said first and second guide members being spaced from said base line toward said saw mounting structure;

b. first and second elongated arms each having one end thereof pivotally connected to said respective first and second fence members at a position spaced from said respective one end thereof, said first and second arms each being in slidable engagement with said respective first and second guide members; and c. first and second locking means on said first and second guide members respectively for engaging said respective first and second arms and holding same against relative movement between said arm and said respective first and second guide member.

4. A power saw apparatus as set forth in claim 3 wherein:

a. said base line has a first and second base line portion extending in opposite directions from the cutting path with each indicating a position for said respective first and second fence members to effect a cut through a work piece at a zero degree miter;

b. said top member has first and second angle scales thereon positioned on respective opposite sides of said cutting path and each adapted to have said respective first and second fence members movable therealong to indicate angular spacing between same and the respective base line on said top member; and c. indicia means are mounted on each of said first and second fence members with each being arranged with zero at said cutting path and increasing along said respective fence member to indicate length of work piece remaining after cutting thereof by said power saw blade.

5. An attachment for a power saw apparatus having a support structure with a table top portion and means on said support structure for mounting a power saw and guiding same during movement thereof along a cutting path, said attachment comprising:

a. a top member having front and rear edges and having a cutting path therein subtantially normal to said front and rear edges and a base line normal to said cutting path, said top member being adapted to be removably mounted on a table top portion of a power saw support structure;

b. first and second fence members positioned on respective opposite sides of said cutting path and each having one end thereof pivotally mounted on said top member at said base line and adjacent said cutting path in said top member for permitting movement of said fence members in either direction from said base line to selected angular positions relative to said cutting path.

6. An attachment for a power saw apparatus as set forth in claim 5 wherein said first and second means for retaining said respective first and second fence membes in a respective selected position includes:

a. first and second guide members each rotatably mounted on said top member and positioned on respective opposite sides of said cutting path in said top member and spaced therefrom, said first and second guide members each being spaced from the base line toward a saw mounting structure;

b. first and second elongated arms each having one end thereof pivotally connected to said respective first and second fence members at a position spaced from said respective one end thereof, said first and second arms each being in slidable engagement with said respective first and second guide members; and c. first and second locking means on said first and second guide members respectively for engaging said respective first and second arms and holding same against relative movement between said arm and said respective first and second guide member.

7. An attachment for a power saw apparatus as set forth in claim 6 wherein:

a. said base line has a first and second base line portion extending in opposite directions from the cutting path with each indicting a position for said respective first and second fence members to effect a cut through a work piece at a zero degree miter; and b. said top member has first and second angle scales thereon positioned on respective opposite sides of said cutting path and each adapted to have said respective first and second fence members independently movable relative thereto and to either side of the respective base line portion to indicate angular spacing between the fence member and the respective base line on said top member.

8. An attachment for a power saw apparatus as set forth in claim 7 including indicia means mounted on each of said first and second fence members, said indicia means each being with zero at said cutting path and increasing along said respective fence member to indicate length of work piece remaining after cutting thereof by the power saw.

* * * * *